US005724853A

United States Patent [19]

Johansson

[11] Patent Number: 5,724,853

[45] Date of Patent: Mar. 10, 1998

[54] MEANS FOR A DISCONNECTABLE BRACING OF A PULLING DEVICE

[75] Inventor: Uno Johansson, Linköping, Sweden

[73] Assignee: Uno Liner System AB, Svedengatan 2, S-582 73 Linkoping, Sweden

[21] Appl. No.: 765,610

[22] PCT Filed: Jul. 5, 1995

[86] PCT No.: PCT/SE95/00826

§ 371 Date: Dec. 23, 1996

§ 102(e) Date: Dec. 23, 1996

[87] PCT Pub. No.: WO96/01158

PCT Pub. Date: Jan. 18, 1996

[30] Foreign Application Priority Data

Jul. 6, 1994 [SE] Sweden ..... 9402385

[51] Int. Cl.[6] ..... B21D 1/12

[52] U.S. Cl. ..... 72/457; 72/705

[58] Field of Search ..... 72/457, 705

[56] References Cited

U.S. PATENT DOCUMENTS 4,055,061 10/1977 Bayorgeon et al. .
4,505,145 3/1985 Bergstrom et al. .
4,791,802 12/1988 Celette .

FOREIGN PATENT DOCUMENTS 0065942 1/1982 European Pat. Off. .

*Primary Examiner*—Lowell A. Larson
*Attorney, Agent, or Firm*—Merchant, Gould, Smith, Edell, Welter & Schmidt, P.A.

[57] ABSTRACT

The invention relates to a device for the detachable securing of a supporting arrangement 91) to a substantially rectangular repair platform (3) constructed of beams, on which a damaged vehicle is intended to be secured during the work of repair. The beams, on their respective outwardly facing sides are constructed with channel-shaped profiled members (4*a*, 4*b*) with mutually facing openings. These profiled members are conventionally used for fixing of equipment for repair work. At the respective beam, the lower channel-shaped profiled member (4*b*) projects below the outwardly facing lower edge line (3*c*1), of the beam side. The supporting arrangement (1) is constructed with a member (5), on the one hand for engagement with the upper side (4*a*1) of the upper channel-shaped profiled member (4*a*) and with the front sides (4*a*2, 4*b*1) of the channel-shaped members (4*a*, 4*b*), and, on the other hand, for engagement into the upper channel-shaped member (4*a*) and behind the downwardly-projecting part of the lower channel-shaped profiled member below the forward lower edge line.

2 Claims, 3 Drawing Sheets

MEANS FOR A DISCONNECTABLE BRACING OF A PULLING DEVICE

Figure 1A:
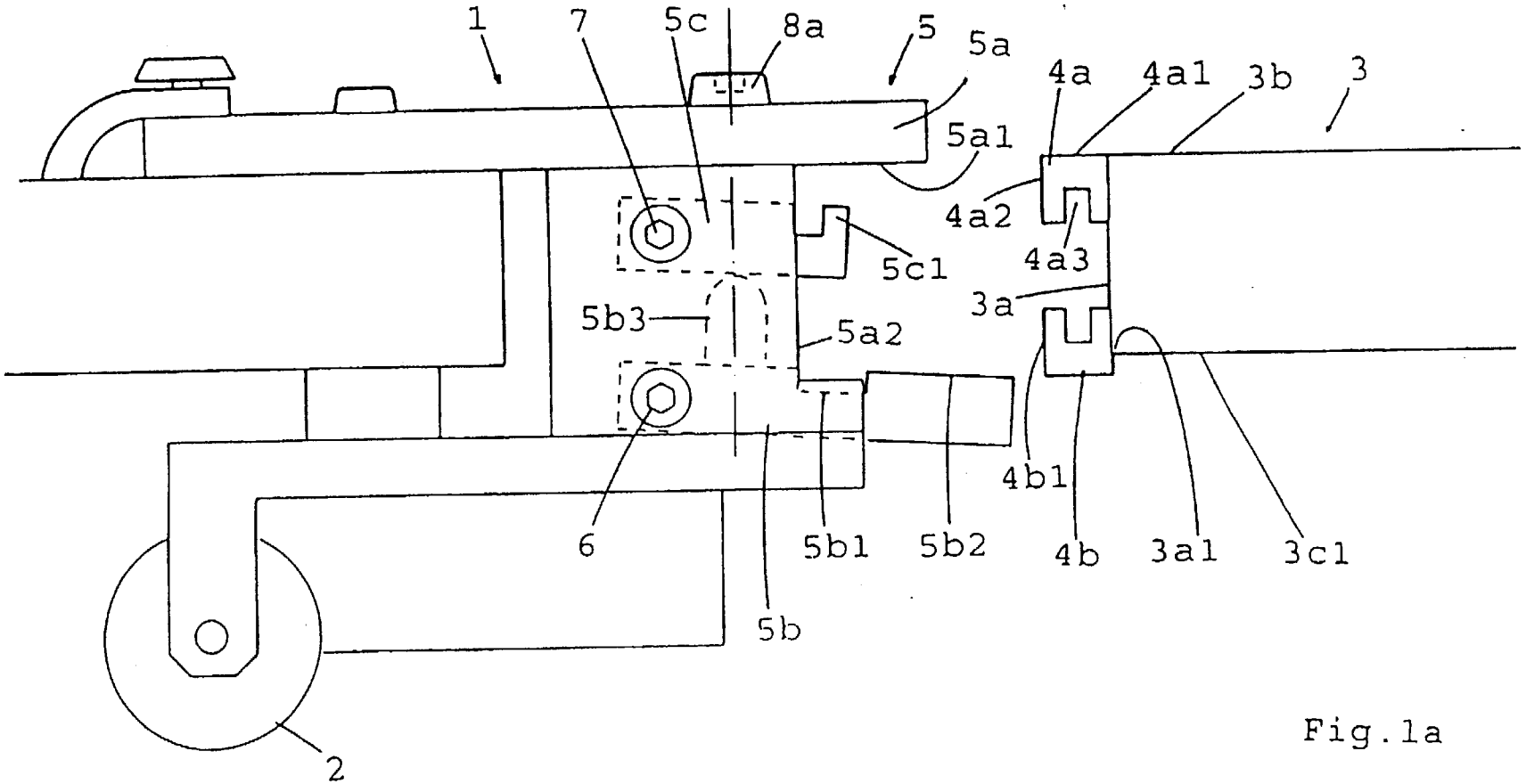

The present invention relates to a device for the detachable securing of a repair platform constructed of beams and substantially rectangular, on which a damaged vehicle is intended to be secured during the work of repairs, whereby said beams, on their respective outwardly facing sides are constructed with channel-shaped profiled members placed in an area of the upper and lower horizontal edges of said sides, having mutually facing openings, said profiled members being conventionally used for the fixing of equipment for repair work.

Such a securing device is known from EP-B1-0065942. The securing member in this case contains a seat of channel-shaped cross-section and consists of three plates: an upper one, a lower one and a plate joining these with a space between them, intended to engage with the upper, lower and outer sides of the beam. A locking member consisting of a rotatably mounted knob can, by being rotated half a turn, be made to grip round the inner lower corner, and to engage with a lower part of the inner side of the beam. The knob is designed with a locking key intended to prevent it turning during the work of repairs, which would lead to the supporting arrangement coming loose from the beam.

It has been found that this known supporting arrangement, in the event of a lack of balance, can slide to some extent along the beam, which, naturally, is detrimental to a good repair outcome and even constitutes a danger to the personnel carrying out the work of repair.

Furthermore, this known device is relatively cumbersome and time-consuming in its securing to the repair platform, and it also suffers from the drawback that one could easily forget to place the key in the intended manner.

The object of the present invention is to provide a device of the type first defined hereinabove by means of which an effective fixing is achieved on the repair platform, and the construction of which is such that slipping movements between the supporting arrangement and the repair platform are eliminated.

This is achieved according to the invention in that, at the respective beam, the lower profiled member projects below the outwardly facing lower edge line of the beam side; in that the supporting arrangement is constructed with a member, on the one hand, for engagement with at least the upper side of the channel-shaped profiled member and with the front sides of the channel-shaped members, and, on the other hand, for engagement into the upper channel-shaped member and behind the downwardly-projecting part of the lower channel-shaped profiled member below the forward lower edge line.

An advantageous construction of the securing arrangement is characterized, as claim 2 indicates, in that said member contains a structural part stationary relative to the supporting arrangement which is designed to engage with the upper side of the upper channel-shaped member and with the front sides of the channel-shaped members, a first lever part rotatable around a first axle designed to bring about an engagement behind the lower channel-shaped member, and a second locking part, rotatable around a second axle and situated on an upwardly pointing projection on the first part, designed to come into engagement with the downwardly facing opening of the upper channel-shaped member.

Figure 1B:
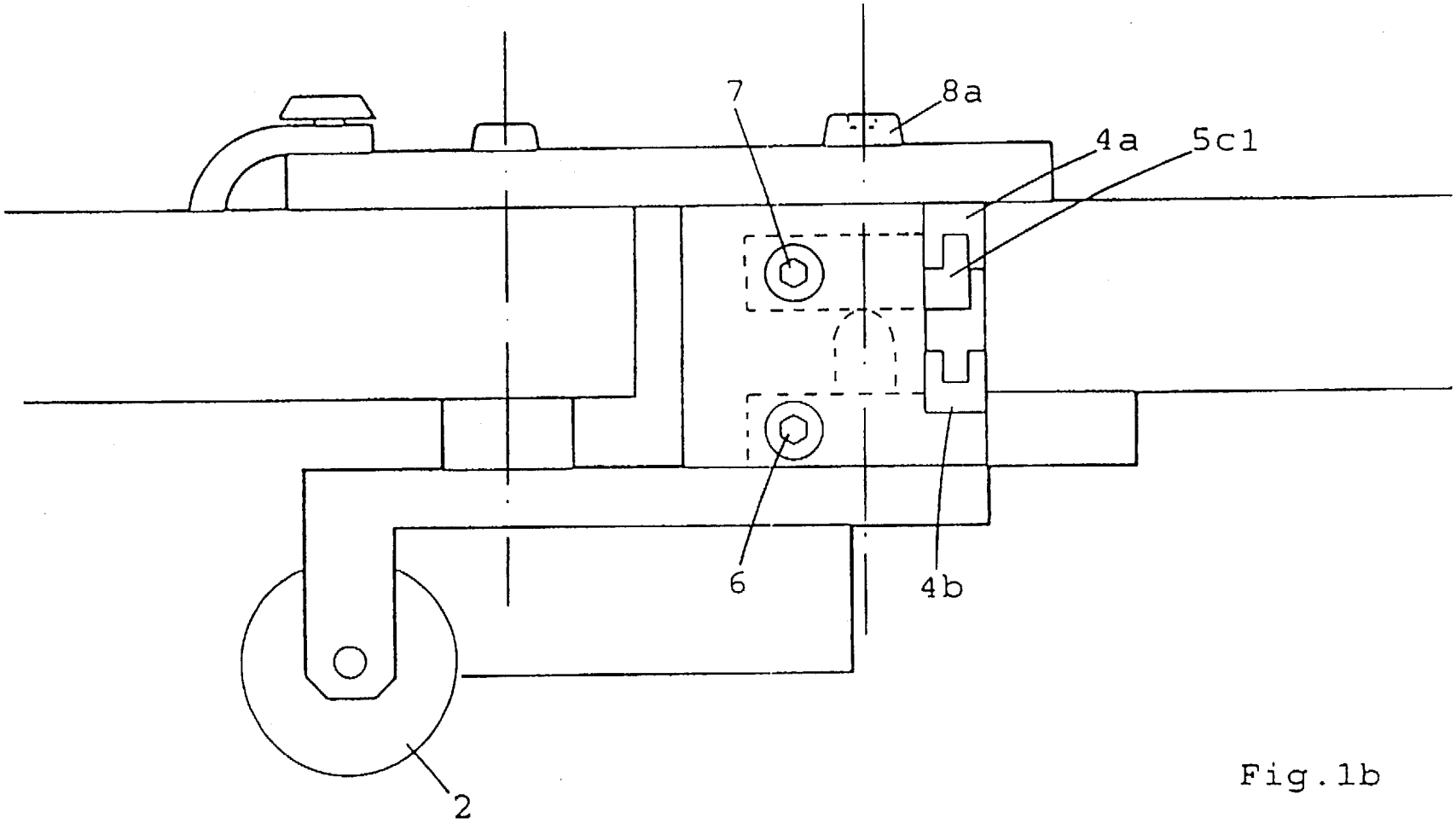
Figure 2:
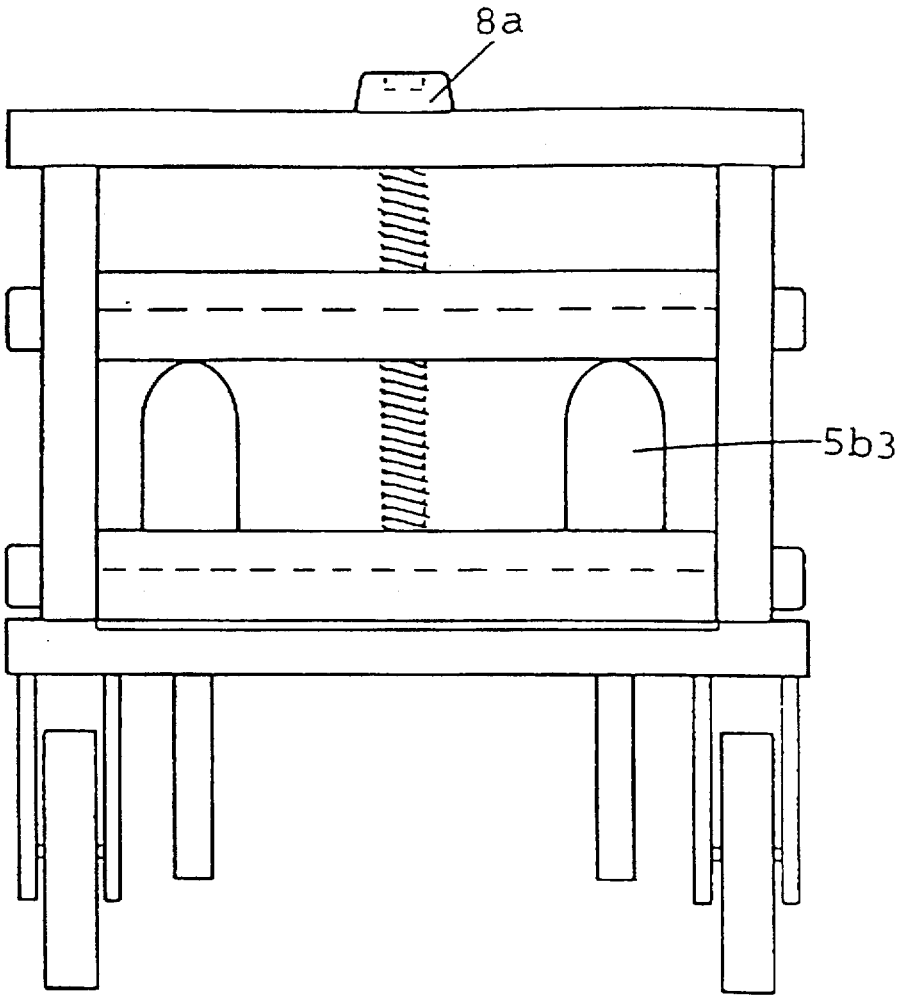

The invention will be explained in detail hereinbelow with reference to the attached drawings in which FIGS. 1*a* and 1*b* show, in plan view from the side, a securing arrangement of the invention in and out of engagement with a repair platform. FIG. 2 shows the securing arrangement in a plan view seen from the repair platform in FIG. 1*a*.

In the drawing 1 denotes generally part of a supporting platform carried by wheels 2 which, in everything except the securing arrangement, is of conventional type, and 3 denotes generally a part of a rectangular repair platform constructed of beams. This is, on its outwardly facing sides 3*a*, provided with two channel-shaped profiled members 4*a*, 4*b*, which, with their openings facing each other, are placed above and below on said outwardly facing side. These profiled members are conventionally used for the securing of legs or wheels to support the repair platform and the securing arrangements by means of which the vehicle, which is to be repaired, is fixed on the platform. For greater clarity these profiled members 4*a*, 4*b* have not been shown, and they should have been facing outwards from the plan of the drawing. The supporting arrangement and the repair platform reversal are well known to the specialist, for example from EP 0 065 942, B1 and, therefore, will not be explained in detail.

According to the invention, the lower channel-shaped member 4*b* protrudes below the outwardly facing lower edge line 3*a*1 of the beam side 3*a*. The supporting arrangement, for securing to the repair platform 3, is constructed with a member, generally denoted by 5, on the one hand for engagement with the upper side 4*a*1 of the upper channel-shaped section 4*a*, in the embodiment shown in the drawing also with the upper side 3*b* of the beam, and with the front sides 4*a*2 and 4*b*1 of the channel-shaped members 4*a*, 4*b*, on the other hand for engagement into the upper channel-shaped profiled member 4*a* and behind the lower channel-shaped section 4*b*, more precisely behind the downwardly-projecting part of the lower channel-shaped member 4*b* below the forward lower edge line.

In the embodiment shown in the drawing, said member 5 contains a structural part 5*a*, which is stationary relative to the supporting arrangement, and which is designed with engagement surfaces 5*a*1, 5*a*2 for engagement with the upper surface 4*a*1 of the upper channel-shaped member 4*a*, and respectively with the upper and lower front surfaces 4*a*1, and 4*b*1 of the upper and lower channel-shaped profiled members.

The member 5 further comprises two movable parts 5*b*, 5*c* which are rotatably mounted on their own axles 6 and 7 respectively. These are oriented transversely to the main direction of the supporting arrangement 1, ie. substantially horizontally during the work of repair. The movable part 5*b* which henceforth will be termed a lever part is designed to provide engagement behind the lower channel-shaped profiled member 4*b*. The lever part 5*b* has for this purpose a corresponding recess 5*b*, but in addition a bearing surface 5*b*2 for bearing abutment against the underside 3*c*1 of the beam of the repair platform 3. The lever part 5*b* has two upwardly-directed projections 5*b*3 against which the other movable part 5*c* bears. This part 5*c* will henceforth be termed a locking part, and is at its outer end 5*c* so designed that it fits into the slit 4*a*3 of the upper channel-shaped profiled member 4*a*3. The lever part 5*b* and with it also the locking part 5*c* is operated from its lower end position out of engagement with the beam 3, which is shown in FIG. 1*a*, to the upper end position in engagement with the beam, which is shown in FIG. 1*b*, by means of the rotation of a threaded screw 8 provided at the top with a hexagonal head 8 intended for the appropriate spanner.

Hereinbelow, the securing of the supporting arrangement to the repair platform will be briefly explained; reversing the sequence of operations will release the supporting arrangement from the repair platform.

From a position shown in FIG. 1*a* the supporting arrangement is rolled with the help of its wheels 2 to a position at the repair platform 3, the surface 5*a* of which bears against the surfaces 4*a*1, 3*b*, and the surface 5*a*2 against surfaces 4*a*2, 4*b*1. By turning the screw 8 clockwise, the lever arm 5*b* rises and therewith also the locking pare 5*c*, so that the downwardly projecting part 4*b* of the channel-shaped profiled member 4*b* engages into the recess 5*b*1, the surface 5*b*2 engages the surface 3*c*1, and so that the outer end 5*c*1 of the locking part 5*c* can grip into the downwardly-facing slit 4*a*3 of the upper channel-shaped member. In this way, there is achieved a very reliable, play-free and robust securing of the supporting arrangement to the repair platform.

I claim:

1. A device for the detachable securing of a supporting arrangement (1) to a substantially rectangular repair platform (3) constructed of beams, on which a damaged vehicle is intended to be secured during the work of repairs, whereby said beams, on their respective outwardly facing sides are constructed with channel-shaped profiled members (4*a*, 4*b*) placed in an area of the upper and lower horizontal edges of said sides, having mutually facing openings, said profiled members being conventionally used for the fixing of equipment for repair work, characterized in that, at the respective beam, the lower profiled member (4*b*) projects below the outwardly facing lower edge line of the beam side; in that the supporting arrangement (1) is constructed with a member, on the one hand, for engagement with at least the upper side of the channel-shaped profiled member and with the front sides of the channel-shaped members, and, on the other hand, for engagement into the upper channel-shaped member and behind the downwardly-projecting part of the lower channel-shaped profiled member below the forward lower edge line.

2. A device according to claim 1, characterized in that, said member contains a structural part (5*a*) stationary relative to the supporting arrangement (1) which is designed to engage with the upper side (4*a*1) of the upper channel-shaped member (4*a*) and against the front sides (4*a*2, 4*b*1) of the channel-shaped members (4*a*, 4*b*), a first lever part (5*b*) rotatable around a first axle (6) designed to bring about an engagement behind the lower channel-shaped profiled member (4*b*), and a second locking part (5*c*), rotatable around a second axle (7), and situated on an upwardly pointing projection (5*b*3) on the first part, designed to come into engagement with the downwardly facing opening (4*a*3) of the upper channel-shaped profiled member (4*a*).

* * * * *